US007959265B2

(12) United States Patent
Shim et al.

(10) Patent No.: US 7,959,265 B2
(45) Date of Patent: Jun. 14, 2011

(54) THERMAL INKJET PRINTHEAD

(75) Inventors: Dong-sik Shim, Suwon-si (KR); Hyung Choi, Seongnam-si (KR); Yong-seop Yoon, Seoul (KR); Chang-seung Lee, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 809 days.

(21) Appl. No.: 11/483,721

(22) Filed: Jul. 11, 2006

(65) Prior Publication Data

US 2007/0126804 A1 Jun. 7, 2007

(30) Foreign Application Priority Data

Dec. 7, 2005 (KR) ..... 10-2005-0118839

(51) Int. Cl.
*B41J 2/045* (2006.01)
*B41J 2/015* (2006.01)

(52) U.S. Cl. ..... 347/71; 347/20

(58) Field of Classification Search ..... 347/71, 347/20

See application file for complete search history.

(56) References Cited

U.S. PATENT DOCUMENTS

| | | | | |
|---|---|---|---|---|
| 2003/0058308 | A1* | 3/2003 | Yamamoto | 347/64 |
| 2003/0076663 | A1* | 4/2003 | Hirano et al. | 361/760 |
| 2004/0040929 | A1* | 3/2004 | Kim | 216/27 |
| 2004/0135850 | A1* | 7/2004 | Kim | 347/63 |

FOREIGN PATENT DOCUMENTS

JP 10-76649 A 3/1998

* cited by examiner

*Primary Examiner* — Stephen D Meier
*Assistant Examiner* — Sarah Al-Hashimi
(74) *Attorney, Agent, or Firm* — Sughrue Mion, PLLC

(57) ABSTRACT

Provided is a thermal inkjet printhead. The inkjet printhead includes a substrate; an insulating layer formed on the substrate; a heater formed on the insulating layer and an electrode to apply current to the heater; a chamber layer that is stacked on the insulating layer and includes an ink chamber; a nozzle layer that is stacked on the chamber layer and includes a nozzle; and at least a heat transfer layer that is formed inside the insulating layer and dissipates heat generated in by the heater toward the substrate.

14 Claims, 2 Drawing Sheets

THERMAL INKJET PRINTHEAD

CROSS-REFERENCE TO RELATED PATENT APPLICATION

This application claims priority from Korean Patent Application No. 10-2005-0118839, filed on Dec. 7, 2005, in the Korean Intellectual Property Office, the disclosure of which is incorporated herein in its entirety by reference.

BACKGROUND OF THE INVENTION

1. Field of the Invention

The present invention relates to an inkjet printhead and, more particularly, to a thermal inkjet printhead in which heat is prevented from accumulating around a heater, thereby improving ink ejection capability.

2. Description of the Related Art

An inkjet printhead is an apparatus that ejects minute ink droplets on desired positions of recording paper in order to print predetermined color images. Inkjet printers are classified into a shuttle type inkjet printer whose printhead is shuttled in a direction perpendicular to the direction of transporting a print medium to print an image and a line printing type inkjet printer having a page-wide array printhead corresponding to the width of a print medium. The latter has been developed for realizing high-speed printing. The array printhead has a plurality of inkjet printheads arranged in a predetermined configuration. In the line printing type inkjet printer, during printing, the array printhead is fixed and a print medium is transported, thereby enabling high-speed printing.

Inkjet printheads are categorized into two types according to the ink droplet ejection mechanism thereof. The first one is a thermal inkjet printhead that ejects ink droplets due to an expansion force of ink bubbles generated by thermal energy. The other one is a piezoelectric inkjet printhead that ejects ink droplets by a pressure applied to ink due to the deformation of a piezoelectric body.

The ink droplet ejection mechanism of the thermal inkjet printhead is as follows. When a current flows through a heater made of a heating resistor, the heater is heated and ink near the heater in an ink chamber is instantaneously heated up to about 300° C. Accordingly, ink bubbles are generated by ink evaporation, and the generated bubbles are expanded to exert a pressure on the ink filled in the ink chamber. Thereafter, an ink droplet is ejected through a nozzle out of the ink chamber.

FIG. 1 is a schematic view of a cross-sectional view of a conventional thermal inkjet printhead. Referring to FIG. 1, the conventional inkjet printhead includes a substrate 10 on which a plurality of material layers are formed, a chamber layer 20 stacked on the substrate 10, and a nozzle layer 30 stacked on the chamber layer 20. An ink chamber 22 filled with ink to be ejected is formed in the chamber layer 20 and a nozzle 32 through which ink is ejected is formed in the nozzle layer 30. In addition, the substrate 10 has an ink feed hole 11 to supply ink to the ink chamber 22.

A typical silicon substrate is used as the substrate 10. An insulating layer 12 for insulation between a heater 13 and the substrate 10 is formed on the substrate 10. The insulating layer 12 is typically made of silicon oxide. Though not illustrated in the drawings, a plurality of CMOS for driving the heater 13 are formed on the substrate 10 and wires for electrically connecting the CMOS and the heater 13 are formed in a plurality of layers inside the insulating layer 12. The heater 13 is formed on the insulating layer 12 to heat the ink of the ink chamber 22 and generate bubble. An electrode 14 is formed on the heater 13 to apply current to the heater 13.

A passivation layer 15 is formed on the heater 13 and the electrode 14 to protect the heater 13 and the electrode 14. The passivation layer 15 is typically made of silicon oxide or silicon nitride. An anti-cavitation layer 16 is formed on the passivation layer 15. The anti-cavitation layer 16 protects the heater 13 from a cavitation force when the bubbles vanish and is typically made of tantalum (Ta).

In the above configuration, the heat produced by the heater 13 and not used to generate ink bubbles must be dissipated toward the substrate 10 through the insulating layer 12 formed under the heater 13. However, as the insulating layer 12 is made of silicon oxide, which has low thermal conductivity, the heat generated by the heater 13 is not dissipated toward the substrate 10 and is accumulated around the heater 13. Meanwhile, since wires are formed in a plurality of layers inside the insulating layer 12, it is difficult to reduce the thickness of the insulating layer 12 so that heat can be dissipated toward the substrate 10. The heat accumulated inside the insulating layer 12 increases the temperature of the ink filled in the ink chamber 22 and thus changes the ink viscosity, and the change of the ink viscosity deteriorates the ejection frequency and speed of the ink.

Recently, as high integration and high speed for printheads are required, line printing type inkjet printers have been actively developed. Such line printing type printers include array printheads with a large number of heaters that generate much heat. Accordingly, when the conventional thermal inkjet printheads are used for array printheads, the ink ejection capability thereof may deteriorate even more.

SUMMARY OF THE INVENTION

The present invention provides a thermal inkjet printhead in which heat is prevented from accumulating around a heater, thereby improving ink ejection capability.

According to an aspect of the present invention, there is provided a thermal inkjet printhead comprising: a substrate; an insulating layer formed on the substrate; a heater formed on the insulating layer and an electrode that applies a current to the heater; a chamber layer that is stacked on the insulating layer and includes an ink chamber; a nozzle layer that is stacked on the chamber layer and includes a nozzle; and at least one heat transfer layer that is formed inside the insulating layer and dissipates heat generated by the heater toward the substrate.

According to another aspect of the present invention, there is provided a thermal inkjet printhead comprising: a substrate; an insulating layer formed on the substrate; a heater formed on the insulating layer and an electrode that applies a current to the heater; a chamber layer that is stacked on the insulating layer and includes an ink chamber; a nozzle layer that is stacked on the chamber layer and includes a nozzle; and means for dissipating heat generated by the heater through the substrate.

The heat transfer layers may be disposed under the heater.

The heat transfer layers may be made of a thermal conductive metal.

The heat transfer layers may be arranged parallel to a surface of the substrate and at least one via hole is formed between neighboring heat transfer layers which connect the heat transfer layers. At least one via hole may be formed between a lowest heat transfer layer and the substrate to connect the heat transfer layer and the substrate.

An ink feed hole may be formed in the substrate to supply ink to the ink chamber.

The substrate may be made of silicon. The insulating layer may be made of silicon oxide.

A passivation layer may be formed on the heater and the electrode to protect the heater and the electrode. The passivation layer may be made of silicon oxide or silicon nitride.

An anti-cavitation layer may be formed on the passivation layer that forms the bottom of the ink chamber. The anti-cavitation layer may be made of tantalum (Ta).

BRIEF DESCRIPTION OF THE DRAWINGS

The above and other features and aspects of the present invention will become more apparent by describing in detail exemplary embodiments thereof with reference to the attached drawings in which.

DETAILED DESCRIPTION OF THE INVENTION

Figure 1:
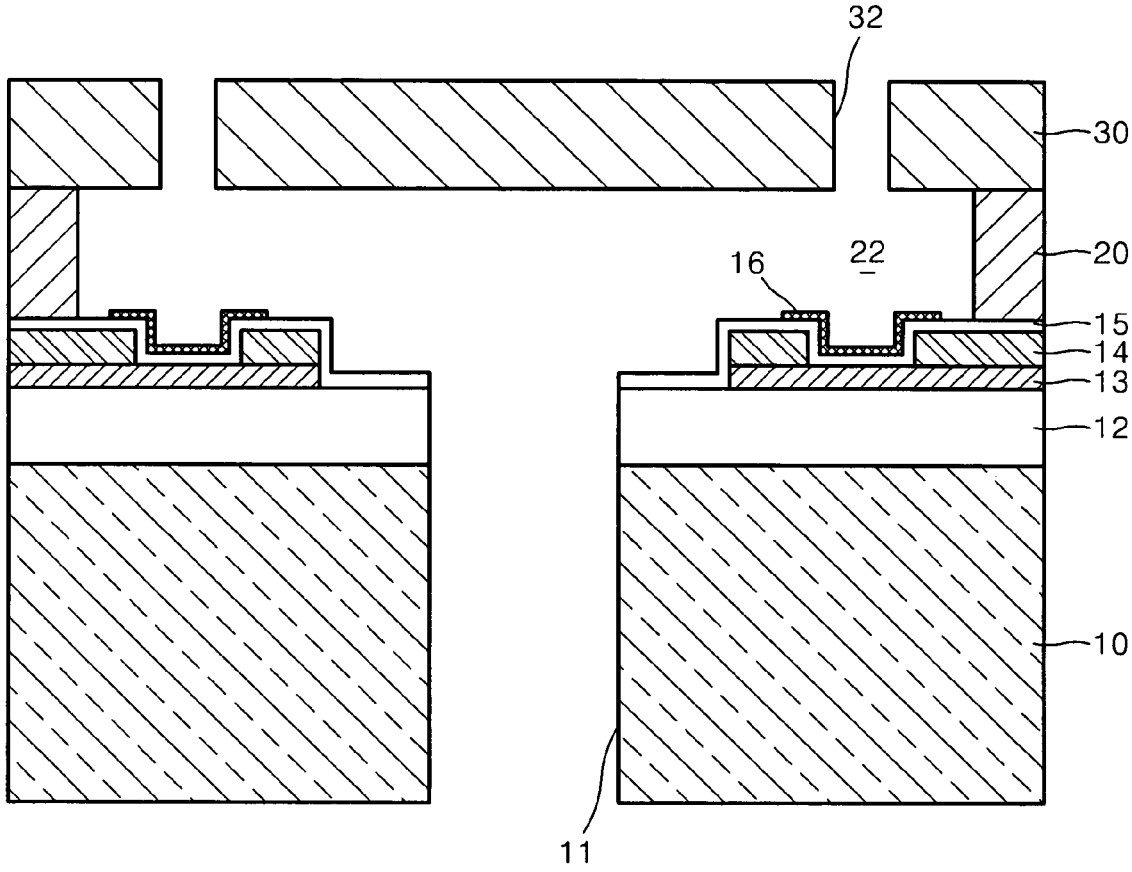
FIG. 1 (PRIOR ART)
FIG. 1 is a schematic view of a conventional thermal inkjet printhead.

Hereinafter, the present invention will be described more fully with reference to the accompanying drawings, in which exemplary embodiments of the invention are shown. In the drawings, like reference numerals denote like elements, and the sizes and thicknesses of layers and regions are exaggerated for clarity.

Figure 2:
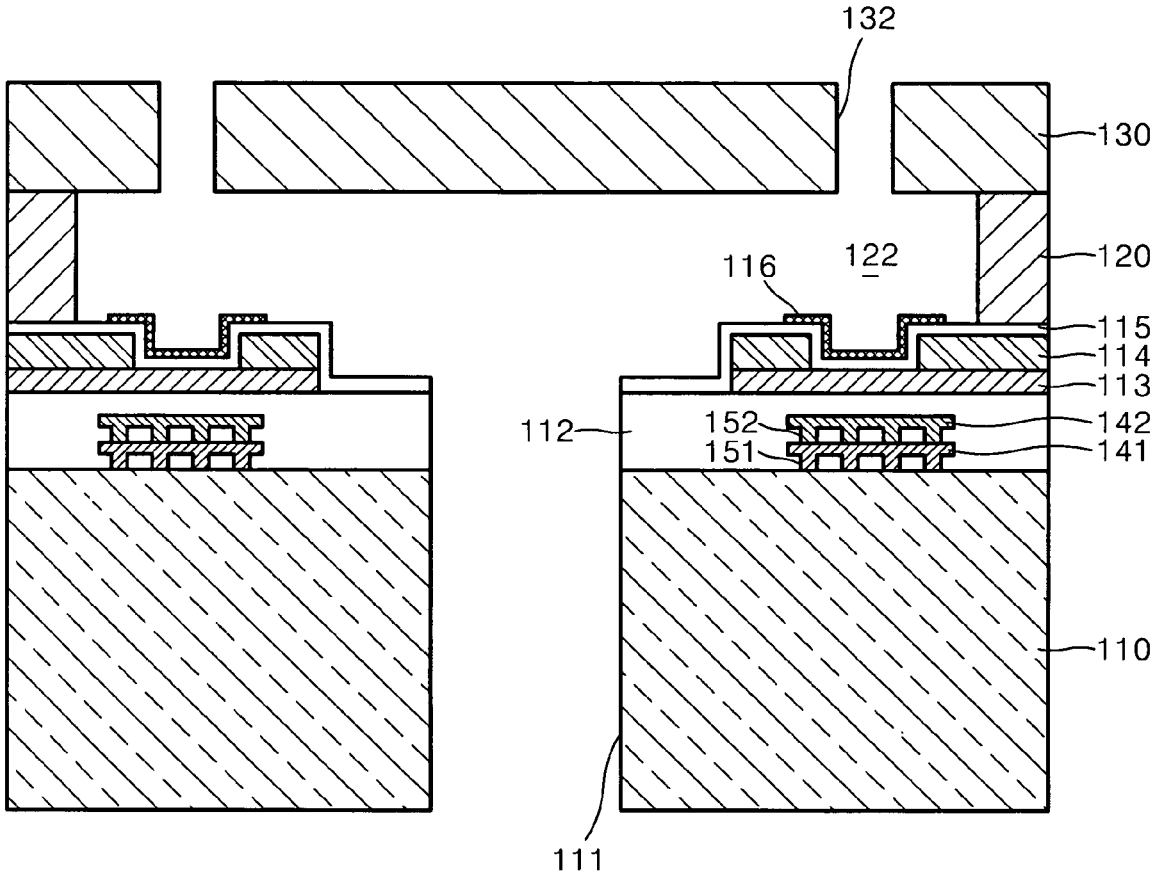
FIG. 2 is a schematic view of a thermal inkjet printhead according to an exemplary embodiment of the present invention.

FIG. 2 is a schematic view of a thermal inkjet printhead according to an exemplary embodiment of the present invention. Referring to FIG. 2, the printhead includes a substrate 110 on which a plurality of material layers are formed, a chamber layer 120 stacked on the substrate 110, and a nozzle layer 130 stacked on the chamber layer 120. An ink chamber 122 filled with ink to be ejected is formed in the chamber layer 120 and a nozzle 132 through which ink of the ink chamber 122 is ejected to the outside is formed in the nozzle layer 130. An ink feed hole 111 is formed in the substrate 110 to supply ink to the ink chamber 122.

The substrate 110 may be typically a silicon substrate. An insulating layer 112 is formed on the substrate 110 with a predetermined thickness for insulation between the substrate 110 and a heater 113, which will be described later. The insulating layer 112 may be typically made of silicon oxide. Though not illustrated in FIG. 2, a plurality of CMOS for driving the heater 13 are formed on the substrate 110 and wires which electrically connect the CMOS and the heater 113 are formed in a plurality of layers inside the insulating layer 112.

The heater 113 which heats the ink of the ink chamber 122 to generate bubble is formed on the insulating layer 112 in a predetermined shape. The heater 113 may be made by depositing a heating resistor like tantalum-aluminum alloy, tantalum nitride, titanium nitride, or tungsten silicide and patterning the heating resistor in a predetermined shape. An electrode 114 is formed on the heater 113 to apply current to the heater 113. The electrode 114 may be formed by depositing a metal having good electric conductivity like aluminum, aluminum alloy, gold, and silver and patterning the metal in a predetermined shape.

A passivation layer 115 is formed on the insulating layer 112 to cover the heater 113 and the electrode 114. The passivation layer 115 protects the heater 113 and the electrode 114 from oxidization or corrosion when they contact the ink and may be typically made of silicon oxide or silicon nitride. An anti-cavitation layer 116 may be further formed on a top surface of the passivation layer 115 that forms the bottom of the ink chamber 122. The anti-cavitation layer 116 protects the heater 113 from a cavitation force which is generated when the bubbles vanish and may be made of tantalum.

First and second heat transfer layers 141 and 142 are formed in the insulating layer 112 to dissipate the heat generated by the heater 113 to the substrate 110. The first and second heat transfer layers 141 and 142 may be formed of a metal having good thermal conductivity. The heat transfer layers 141 and 142 dissipate the heat that is generated by the heater 113 and left inside the insulating layer 112 to the substrate 110 in order to prevent the heat from accumulating inside the insulating layer 112.

The first and second heat transfer layers 141 and 142 are arranged parallel to a surface of the substrate 110. The first and second heat transfer layers 141 and 142 may be arranged below the heater 113, specifically, directly below the heating portion of the heater 113, in order to dissipate heat efficiently to the substrate 110. To this end, in the present embodiment, wires (not shown) which are formed in a plurality of layers inside the insulating layer 112 to drive the heater 113 may be arranged in a portion of the area lower than the heater 113 except for a portion directly below the heating portion of the heater 113. The first and second heat transfer layers 141 and 142 may be formed simultaneously with the wires to drive the heater 113.

At least one first via hole 151 may be formed between the first heat transfer layer 141, which is the lowest of the first and second heat transfer layers 141 and 142, and the substrate 110. The first heat layer 141 and the surface of the substrate 110 are connected through these first via holes 151. In addition, at least one second via hole 152 may be formed between the first heat transfer layer 141 and the second heat transfer layer 142. The first and second heat transfer layers 141 and 142 are connected through the second via holes 152.

In the present embodiment, two heat transfer layers 141 and 142 are formed inside the insulating layer 112. However, the present invention is not limited to this, and one heat transfer layer or more than two heat transfer layers may be formed inside the insulating layer 112. Furthermore, one of skill in the art would recognize that other heat transfer structures, other than the above described heat transfer layers, may be used within the insulating layer 112 to dissipate the generated heat.

In the above described thermal inkjet printhead, when current is applied to the heater 113 via the electrode 114, heat is generated in the heater 113 and the ink in the ink chamber 122 is heated to a predetermined temperature. Thus a bubble is generated and expanded in the ink chamber 122 and the ink in the ink chamber 122 is ejected through the nozzle 132 to the outside by the bubble expansion. The heat generated in the heater 113, except for the heat used to generate the bubble, remains in the insulating layer 112, and is dissipated rapidly toward the substrate 110 through the heat transfer layers 141 and 142, which are made of a material having good thermal conductivity. The heat dissipated toward the substrate 110 through the heat transfer layers 141 and 142 is rapidly cooled since the substrate 110 contacts the ink filled in the ink feed hole 111. Thus, the heat is prevented from accumulating in the insulating layer 112 around the heater 113.

As described above, in the thermal inkjet printhead according to this embodiment of the present invention, heat transfer layers made of a metal having good thermal conductivity are formed in the insulating layers formed between the substrate and the heater, thereby dissipating heat remaining in the insulating layer toward the substrate. Accordingly, the heat is prevented from accumulating in the insulating layer and, thus, the ejection capability of the inkjet printhead, such as ink ejection frequency and ejection speed, can be improved. Also, the present invention can be applied not only to an inkjet printhead of a shuttle type but also to an array printhead of a line printing type. Particularly, since the array printhead includes a predetermined number of inkjet printheads and generates much heat, the present invention can be applied to the array printhead more usefully.

The invention may, however, be embodied in many different forms and should not be construed as being limited to the exemplary embodiments set forth herein; rather, these embodiments are provided so that this disclosure will be thorough and complete, and will fully convey the concept of the invention to those skilled in the art. For example, it will also be understood that when a layer is referred to as being "on" another layer or a substrate, it can be directly on the other layer or the substrate, or intervening layers may also be present. The components of the inkjet printhead according to the present invention may be made of different materials from the current embodiments. While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A thermal inkjet printhead comprising:

a substrate;

an insulating layer formed on the substrate;

a heater formed on the insulating layer and an electrode that applies a current to the heater;

a chamber layer that is stacked on the insulating layer and includes an ink chamber;

a nozzle layer that is stacked on the chamber layer and includes a nozzle; and at least one heat transfer layer that is formed inside the insulating layer and dissipates heat generated by the heater toward the substrate, wherein the at least one heat transfer layer is arranged parallel to a surface of the substrate and at least one via hole is formed between neighboring heat transfer layers which connect the heat transfer layers.

2. The thermal inkjet printhead of claim 1, wherein the at least one heat transfer layer is disposed under the heater.

3. The thermal inkjet printhead of claim 2, wherein the at least one heat transfer layer is made of a thermal conductive metal.

4. The thermal inkjet printhead of claim 1, wherein at least one via hole is formed between a lowest heat transfer layer and the substrate to connect the heat transfer layer and the substrate.

5. The thermal inkjet printhead of claim 1, wherein an ink feed hole is formed in the substrate to supply ink to the ink chamber.

6. The thermal inkjet printhead of claim 1, wherein the substrate is made of silicon.

7. The thermal inkjet printhead of claim 1, wherein the insulating layer is made of silicon oxide.

8. The thermal inkjet printhead of claim 1, wherein a passivation layer is formed on the heater and the electrode to protect the heater and the electrode.

9. The thermal inkjet printhead of claim 8, wherein the passivation layer is made of silicon oxide or silicon nitride.

10. The thermal inkjet printhead of claim 8, wherein an anti-cavitation layer is formed on the passivation layer that forms the bottom of the ink chamber.

11. The thermal inkjet printhead of claim 10, wherein the anti-cavitation layer is made of tantalum (Ta).

12. A thermal inject printhead comprising:

a substrate;

an insulating layer formed on the substrate;

a heater formed on the insulating layer and an electrode that applies current to the heater;

a chamber layer that is stacked on the insulating layer and includes an ink chamber;

a nozzle layer that is stacked on the chamber layer and includes a nozzle; and means for dissipating heat generated by the heater through the substrate, wherein the means for dissipating heat is arranged parallel to a surface of the substrate and at least one via hole is formed between neighboring heat transfer layers which connect the heat transfer layers.

13. The thermal inkjet printhead of claim 1, wherein the insulating layer is disposed between the at least one heat transfer layer and the heater.

14. The thermal inkjet printhead of claim 12, wherein the insulating layer is disposed between the means for dissipating heat and the heater.

* * * * *